US008220186B2

(12) United States Patent
Nomi et al.

(10) Patent No.: US 8,220,186 B2
(45) Date of Patent: Jul. 17, 2012

(54) SOLE STRUCTURES AND ARTICLES OF FOOTWEAR INCLUDING SUCH SOLE STRUCTURES

(75) Inventors: Craig A. Nomi, Beaverton, OR (US); Jason C. Mayden, Beaverton, OR (US); Gjermund Haugbro, Taichung (TW)

(73) Assignee: Nike, Inc., Beaverton, OR (US)

( * ) Notice: Subject to any disclaimer, the term of this patent is extended or adjusted under 35 U.S.C. 154(b) by 950 days.

(21) Appl. No.: 12/249,466

(22) Filed: Oct. 10, 2008

(65) Prior Publication Data

US 2009/0272008 A1 Nov. 5, 2009

Related U.S. Application Data

(60) Provisional application No. 61/049,146, filed on Apr. 30, 2008.

(51) Int. Cl.

| | |
|---|---|
| ***A43B 13/18*** | (2006.01) |
| ***A43B 21/06*** | (2006.01) |
| ***A43B 13/12*** | (2006.01) |
| ***A43B 21/00*** | (2006.01) |

(52) U.S. Cl. ..... 36/105; 36/28; 36/35 R; 36/30 R

(58) Field of Classification Search ..... 36/92, 103, 36/105, 28, 30 R, 31, 35 R, 37

See application file for complete search history.

(56) References Cited

U.S. PATENT DOCUMENTS

| | | | | |
|---|---|---|---|---|
| 2,619,744 | A * | 12/1952 | Mattes | 36/105 |
| 2,730,818 | A * | 1/1956 | Bidegain | 36/105 |
| 4,794,707 | A * | 1/1989 | Franklin et al. | 36/107 |
| 5,187,883 | A * | 2/1993 | Penney | 36/35 R |
| 5,396,718 | A * | 3/1995 | Schuler et al. | 36/38 |
| 6,330,757 | B1 * | 12/2001 | Russell | 36/28 |
| 6,983,557 | B2 * | 1/2006 | Manz et al. | 36/103 |
| 7,010,872 | B2 * | 3/2006 | Pawlus et al. | 36/100 |
| 7,082,702 | B2 * | 8/2006 | Cretinon | 36/88 |
| 7,204,043 | B2 * | 4/2007 | Kilgore | 36/68 |
| 7,673,397 | B2 * | 3/2010 | Jarvis | 36/28 |
| 2007/0240331 | A1 * | 10/2007 | Borel | 36/28 |

FOREIGN PATENT DOCUMENTS

| | | | |
|---|---|---|---|
| EP | 1402795 | A1 | 3/2004 |
| WO | 2007/069069 | A | 6/2007 |

OTHER PUBLICATIONS

International Preliminary Report on Patentability issued in corresponding PCT Application, International Application No. PCT/US2009/041915, on Nov. 11, 2010.

International Search Report and Written Opinion in corresponding PCT Application, International Application No. PCT/US2009/041915, mailed Oct. 15, 2009.

* cited by examiner

*Primary Examiner* — Khoa Huynh
*Assistant Examiner* — Melissa Lalli
(74) *Attorney, Agent, or Firm* — Banner & Witcoff, Ltd.

(57) ABSTRACT

Footwear sole structures include: (a) a chassis member including a lateral side, a rear heel portion, and a medial side, wherein the chassis member includes an opening defined between the medial side and the lateral side; (b) an impact-attenuating member engaged with the chassis member, wherein the impact-attenuating member includes a lateral side arm and a medial side arm that extend toward a forefoot portion of the sole structure, and wherein the impact-attenuating member further includes a rear heel portion joining the lateral and medial side arms; and (c) an outsole element extending beneath the impact-attenuating member, wherein the outsole element extends around the rear heel portion of the impact-attenuating member and engages the rear heel portion of the chassis member.

14 Claims, 12 Drawing Sheets

SOLE STRUCTURES AND ARTICLES OF FOOTWEAR INCLUDING SUCH SOLE STRUCTURES

RELATED APPLICATION DATA

This application is a non-provisional patent application that claims priority to U.S. Provisional Patent Appln. No. 61/049,146 filed Apr. 30, 2008, in the name of Craig A. Nomi. This earlier provisional application is entirely incorporated herein by reference.

FIELD OF THE TECHNOLOGY

This invention relates generally to articles of footwear. In particular, the present invention relates to sole structures and articles of footwear including such sole structures.

BACKGROUND

Conventional articles of athletic footwear have included two primary elements, namely an upper and a sole member or structure. The upper provides a covering for the foot that securely receives and positions the foot with respect to the sole structure. In addition, the upper may have a configuration that protects the foot and provides ventilation, thereby cooling the foot and removing perspiration. The sole structure generally is secured to a lower portion of the upper and generally is positioned between the foot and the ground. In addition to attenuating ground reaction forces, the sole structure may provide traction and control foot motions, such as pronation. Accordingly, the upper and the sole structure operate cooperatively to provide a comfortable structure that is suited for a variety of ambulatory and athletic activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that attenuates ground reaction forces and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas.

Despite recent advances, there remains room in the footwear art for lightweight, stable, and comfortable sole structures for articles of footwear, including sole structures for use in athletic footwear.

SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to sole structures and articles of footwear that include such sole structures. Sole structures in accordance with at least some examples of this invention may include: (a) a chassis member including a lateral side, a rear heel portion, and a medial side, wherein the chassis member includes an opening defined between the medial and lateral sides; (b) an impact-attenuating member engaged with the chassis member, wherein the impact-attenuating member includes a lateral side arm and a medial side arm that extend toward a forefoot portion of the sole structure, and wherein the impact-attenuating member further includes a rear heel portion joining the lateral and medial side arms; and (c) an outsole element extending beneath the impact-attenuating member, wherein the outsole element extends around the rear heel portion of the impact-attenuating member and engages the rear heel portion of the chassis member. Such sole structures further may include a midsole element, one or more base support plates or members, additional outsole or traction elements, and/or other structures commonly and conventionally used in footwear construction.

Additional aspects of this invention relate to articles of footwear including such sole structures, as well as to methods of making such soles structures and to methods of making articles of footwear including such sole structures.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

Figure 1A:
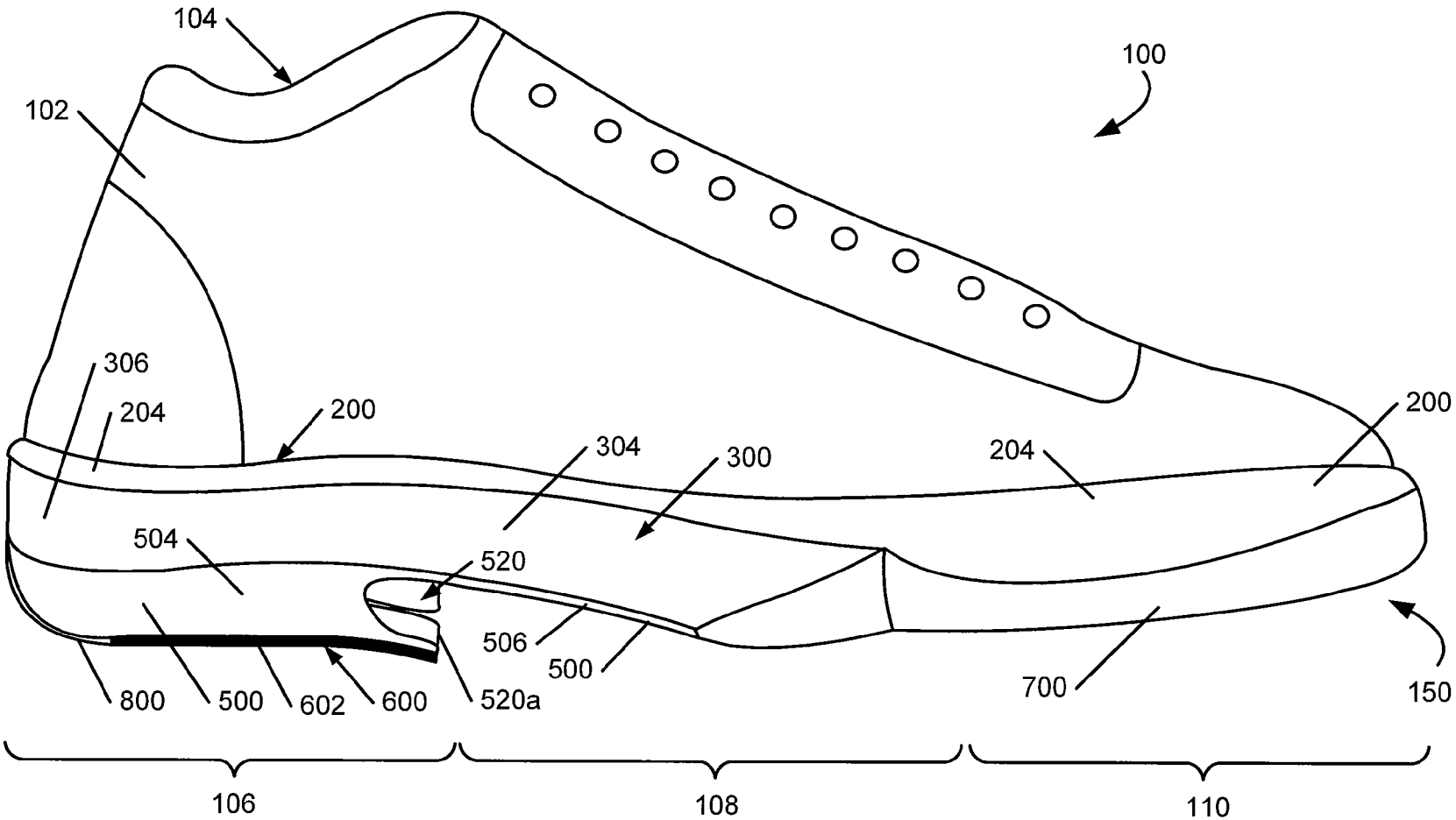
FIGS. 1A through 1C illustrate an example sole structure and article of footwear in accordance with this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example articles of footwear and sole structures according to this invention. Additionally, it is to be understood that other specific arrangements of parts and structures may be utilized in such products, and structural and functional modifications may be made without departing from the scope of the present invention. Also, while the terms "top," "bottom," "front," "back," "rear," "side," "underside," "overhead," "upper," "lower," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. GENERAL DESCRIPTION OF ASPECTS OF THE INVENTION

In general, as described above, aspects of this invention relate to sole structures for articles of footwear and methods of making such products. More detailed descriptions of aspects of this invention follow.

1. Example Sole Structures According to the Invention

Aspects of this invention relate to sole structures for articles of footwear. In accordance with at least some examples of this invention, such sole structures may include: (a) a chassis member including a lateral side, a rear heel portion, and a medial side, wherein the chassis member includes an opening defined between the medial side and the lateral side; (b) an impact-attenuating member engaged with the chassis member, wherein the impact-attenuating member includes a lateral side arm and a medial side arm that extend toward a forefoot portion of the sole structure, and wherein the impact-attenuating member further includes a rear heel portion joining the lateral and medial side arms; and (c) a first outsole element extending beneath the impact-attenuating member, wherein the first outsole element extends around the rear heel portion of the impact-attenuating member and engages the rear heel portion of the chassis member.

Additional aspects of this invention relate to sole structures for articles of footwear that include two or more of the following elements, in any desired combination or arrangement: (a) a midsole member (e.g., including a heel portion for supporting a wearer's heel and a forefoot portion for supporting a wearer's forefoot); (b) a first base support member; (c) a second base support member; (d) a chassis member that may be located between the midsole member and the first base support member and extending from a lateral side of the midsole member, around the heel portion of the midsole member, and to a medial side of the midsole member (if desired, the chassis member may include an opening defined between the medial side and the lateral side, and further if desired, the heel portion of the midsole member may engage the first base support member through the opening in the chassis member); (e) an impact-attenuating member that may be located between the first base support member and the second base support member (e.g., the impact-attenuating member may include a heel portion located between the first and second base support members and an arch portion that extends beyond the second base support member toward a forefoot portion of the sole structure, and the impact-attenuating member may directly engage the midsole member, optionally at the heel area through the opening in the chassis member); (f) a heel outsole element engaged with the second base support member, wherein the heel outsole element may extend around a rear heel portion of the impact-attenuating member and engage a rear heel portion of the chassis member; (g) a forefoot outsole element engaged with at least one of the midsole member, the impact-attenuating member, or the chassis member in the forefoot portion of the sole structure; and/or (h) a connector for engaging a rear heel portion of the first outsole element with the rear heel portion of the chassis member.

2. Example Articles of Footwear According to the Invention

Additional aspects of this invention relate to articles of footwear that include: (a) an upper member at least partially defining an interior chamber for receiving a foot; and (b) a sole structure of the types described above. The upper member may be formed of any desired materials, any desired number of parts, put together in any desired manner without departing from this invention, including through the use of conventional materials, made in conventional parts, put together in conventional manners, without departing from this invention. As some more specific examples, the upper members may be made from leathers, synthetic leathers, textiles, fabrics, polymeric materials, and the like, put together by stitching, sewing, cements, adhesives, mechanical connectors, retaining member structures (e.g., tongue and groove structures), etc.

3. Example Methods According to the Invention

Additional aspects of this invention relate to methods of making articles of footwear of the types described above. Such methods may include: (a) providing a sole structure of the types described above (e.g., by manufacturing them, obtaining them from a third party source, etc.); and (b) engaging the sole structure with an upper member (e.g., of the types described above). Methods for manufacturing the sole structure may include, for example, engaging an outsole element with a chassis member at the rear heel area, e.g., using a mechanical connector, adhesives, cements, etc. The various portions of the sole structure, as well as the sole structure and the upper member, may be engaged in any desired manners without departing from this invention, including in conventional manners as are known and used in the art, such as via stitching or sewing, via cements or adhesives, via mechanical connectors, via retaining member structures, etc.

B. SPECIFIC EXAMPLES OF THE INVENTION

Referring to the figures and following discussion, sole structures and articles of footwear in accordance with the present invention are described. Footwear is depicted and discussed as a basketball shoe, however, the concepts disclosed with respect to footwear may, be applied to a wide range of other athletic footwear styles, including, for example, walking shoes, running shoes, tennis shoes, soccer shoes, football shoes, and cross-training shoes. In addition, the concepts of the present invention may be applied to a wide range of non-athletic footwear, including work boots, sandals, loafers, and dress shoes. Accordingly, the present invention is not limited to the precise embodiments disclosed herein, but applies to footwear and other foot-receiving devices generally.

Figure 1B:
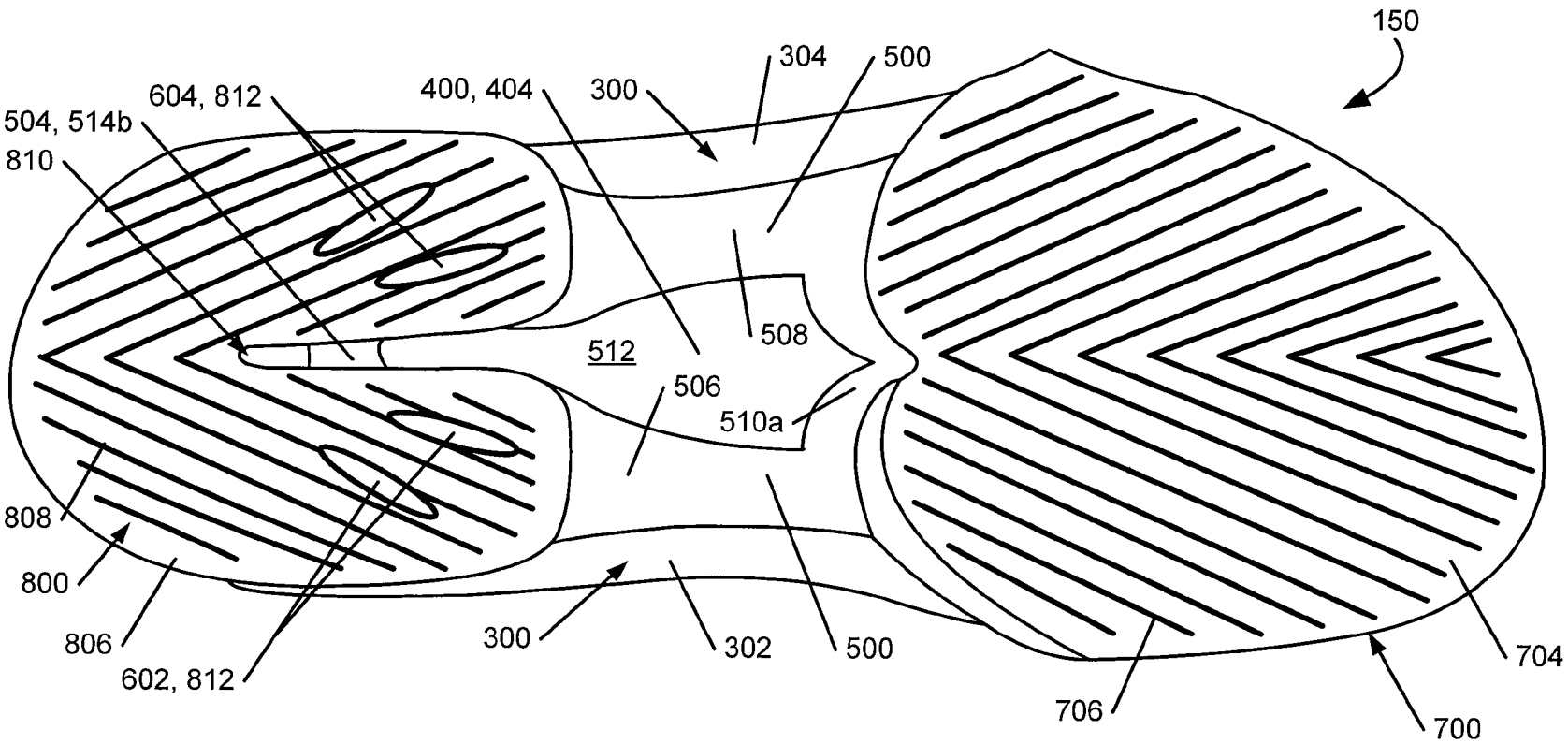
Figure 1C:
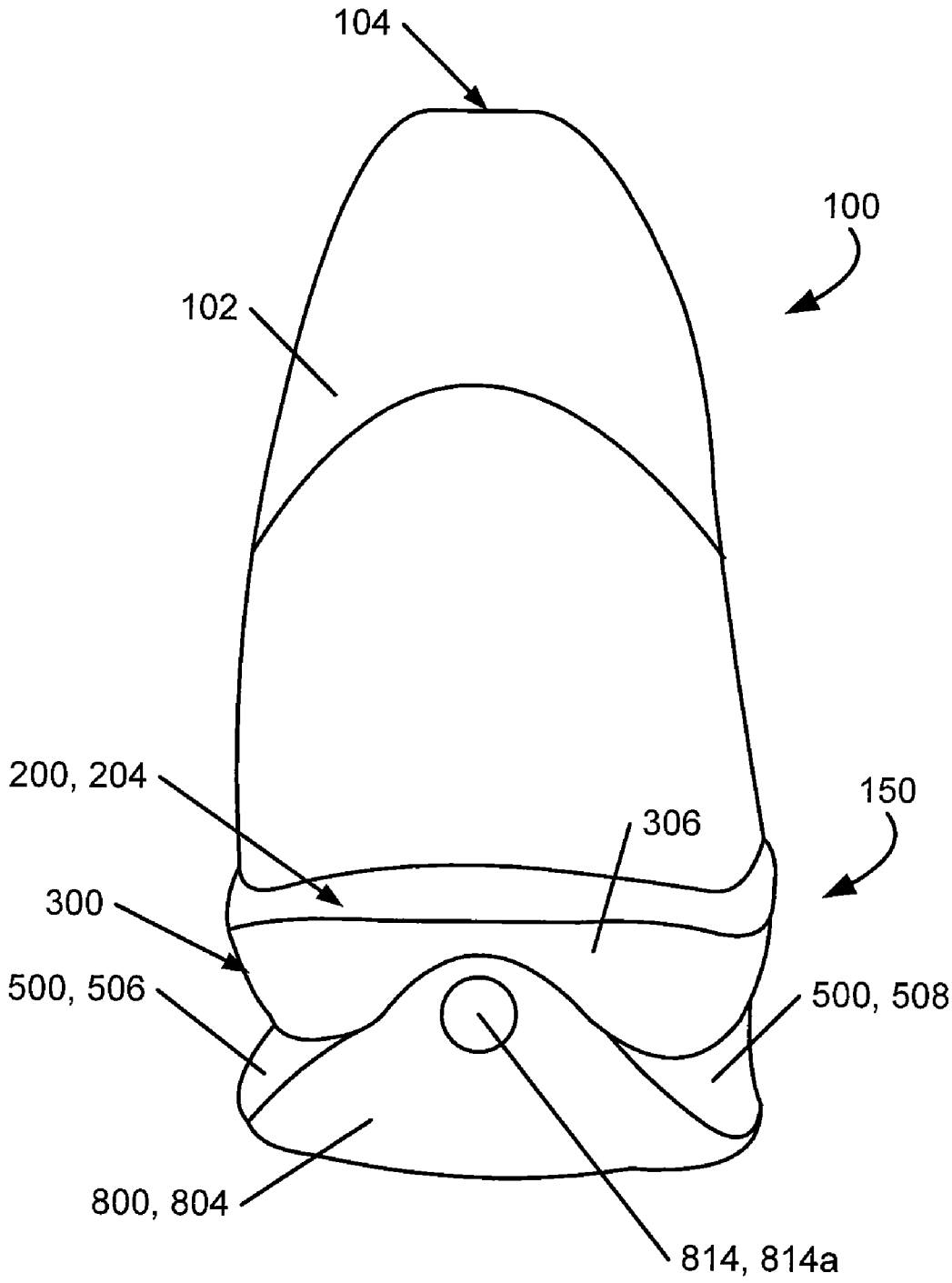

1. General Examples of Sole Structures and Articles of Footwear According to the Invention FIGS. 1A through 1C illustrate an example article of footwear 100 including an upper member 102 and a sole structure 150 engaged with the upper member 102. The upper member 102 may be made from any desired materials, including combinations of different materials, including materials that are conventionally known and used in the art. Examples of suitable materials for the upper member 102 include, but are not limited to: fabrics, textiles, leathers, synthetic leathers, polymeric materials, etc.

Moreover, the upper member 102 may be made from any desired number of pieces or parts, in any desired constructions, including through the use of conventional parts, pieces, and constructions as are known and used in the art. The upper member 102 includes a foot-receiving opening 104, which provides access to an internal chamber for receiving a wearer's foot. The foot-receiving chamber 104 may be defined by the upper member 102 alone or by the upper member 102 in combination with other elements, such as the sole structure 150. The article of footwear 100 further may include structures to help secure the footwear 100 to the wearer's foot, such as a lace and eyelet system as shown in FIG. 1A (although any desired securing system may be used without departing from this invention).

FIG. 1A further illustrates the article of footwear 100 broken up into three general sections, namely, a heel section 106, a central or arch section 108, and a forefoot section 110. These sections 106, 108, and 110 are provided in FIG. 1A simply for identification purposes to facilitate the discussion that follows. These sections 106, 108, and 110 are not intended to demarcate precise areas or regions of an article of footwear 100 or other elements of the article of footwear 100.

FIGS. 1A through 1C further illustrate various elements of an example sole structure 150 in accordance with this invention. The various elements of the sole structure 150 include: a midsole member 200, a chassis member 300, an upper base support member 400, an impact-attenuating member 500, a lower base support member 600, and one or more outsole elements (e.g., forefoot outsole element 700 and heel outsole element 800 illustrated in this example structure). These example elements of the sole structure 150 will be described in more detail below.

2. Midsole Member

Figure 2A:
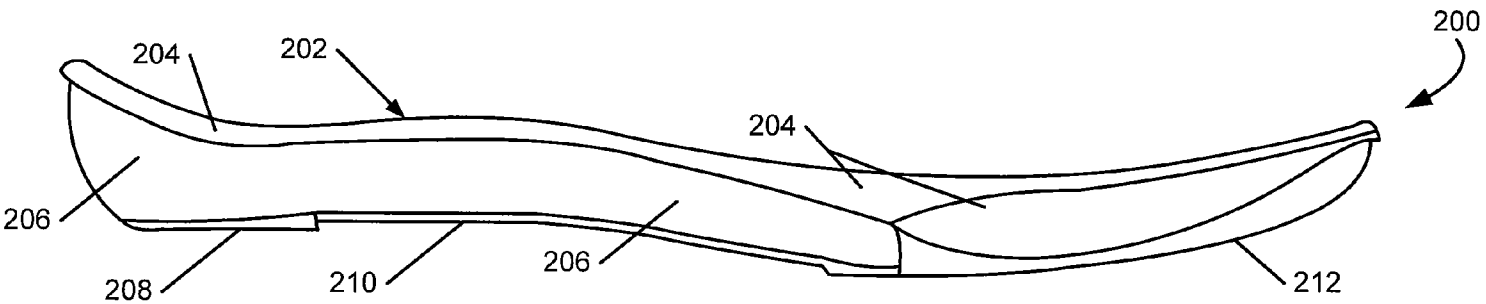
FIGS. 2A and 2B illustrate an example midsole member that may be included in sole structures and articles of footwear in accordance with this invention.
Figure 2B:
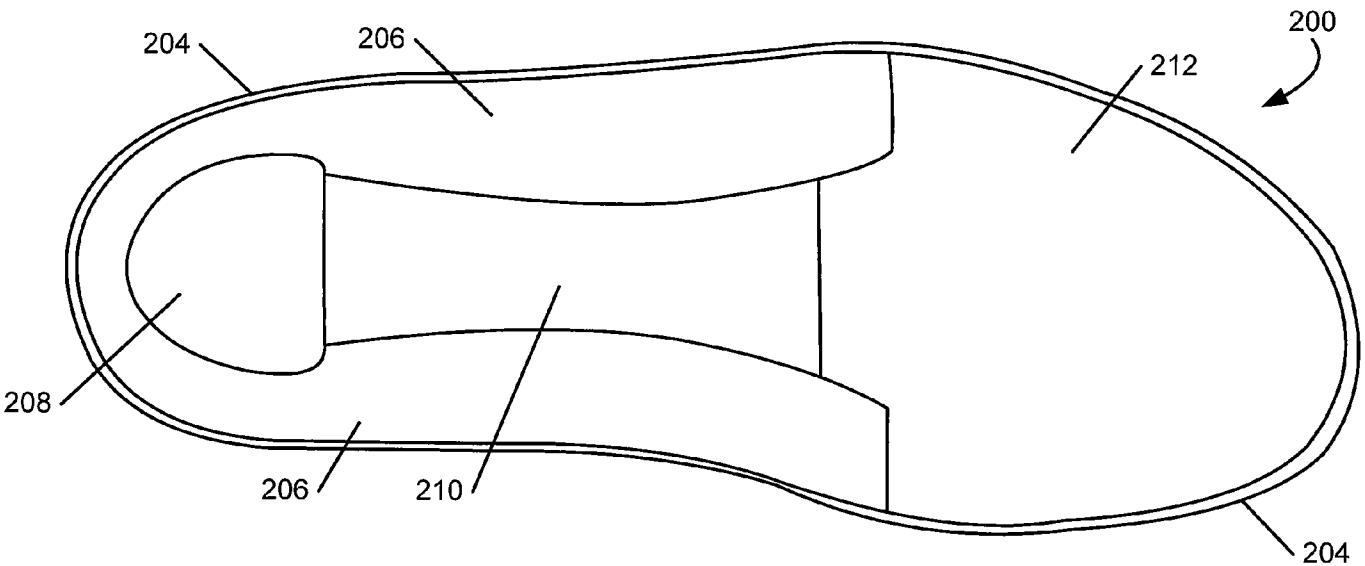

FIGS. 2A and 2B generally illustrate an example midsole structure 200 that may be included in sole structures 150 in accordance with examples of this invention. The midsole structure 200 may be made from any suitable or desired materials, such as polyurethane foam, ethylvinylacetate ("EVA") materials (such as phylon), or other foam materials, including midsole or other impact-attenuating materials that are conventionally known and used in the art. Additionally or alternatively, if desired, the midsole member 200 may include other lightweight impact-attenuating structures, such as one or more fluid-filled bladders, as are commonly known and used in the footwear art. Such bladders, when present, may be located in the heel region 106 of the midsole structure 200, in the forefoot region 110 of the midsole structure 200, or at any other desired location in the midsole structure 200. As yet another example, if desired, the entire midsole structure 200 may constitute one or more fluid-filled bladders.

In this illustrated example, the midsole structure 200 includes an upper major surface 202 shaped and disposed for supporting the entirety of the wearer's foot. If desired, instead of the one-piece structure shown in FIGS. 2A and 2B, the midsole structure 200 may constitute a multi-piece construction that supports all or just some desired portion(s) of a wearer's foot. The midsole structure 200 may be included in a footwear structure 100 such that the upper major surface 202 directly contacts the wearer's foot. Alternatively, if desired, other structures may be disposed between the upper major surface 202 and the wearer's foot, such as an insole member, a bottom surface of the upper structure 102, an interior bootie member in the upper structure 102, etc.

The midsole structure 200 of this example includes an exterior rim 204, which is exposed in the final footwear structure 100. Beneath the exterior rim 204 in this example structure 200, a recessed portion 206 is provided that nests within an interior surface of a chassis member 300, which will be described in more detail below. The bottom surface of the midsole structure 200 further includes an interior heel portion 208 that engages an upper base support plate 400, an arch portion 210 that engages the upper base support plate 400 and/or another impact-attenuating member 500, and a forefoot portion 212 that engages an upper surface of an outsole element 700 in this example sole structure 150. This example arrangement of parts and their assembly will be described in more detail below.

3. Chassis Member

Figure 3A:
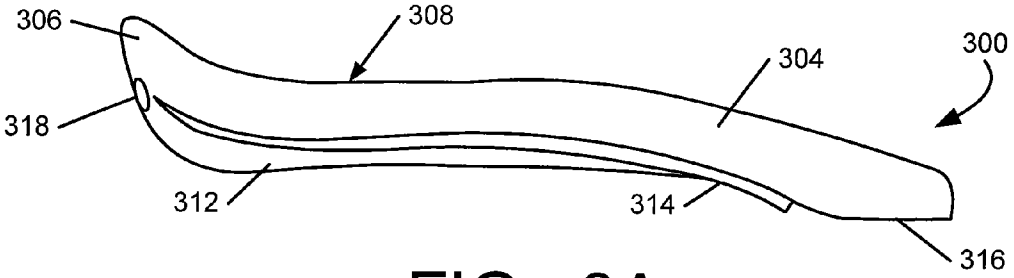
FIGS. 3A and 3B illustrate an example chassis member that may be included in sole structures and articles of footwear in accordance with this invention.
Figure 3B:
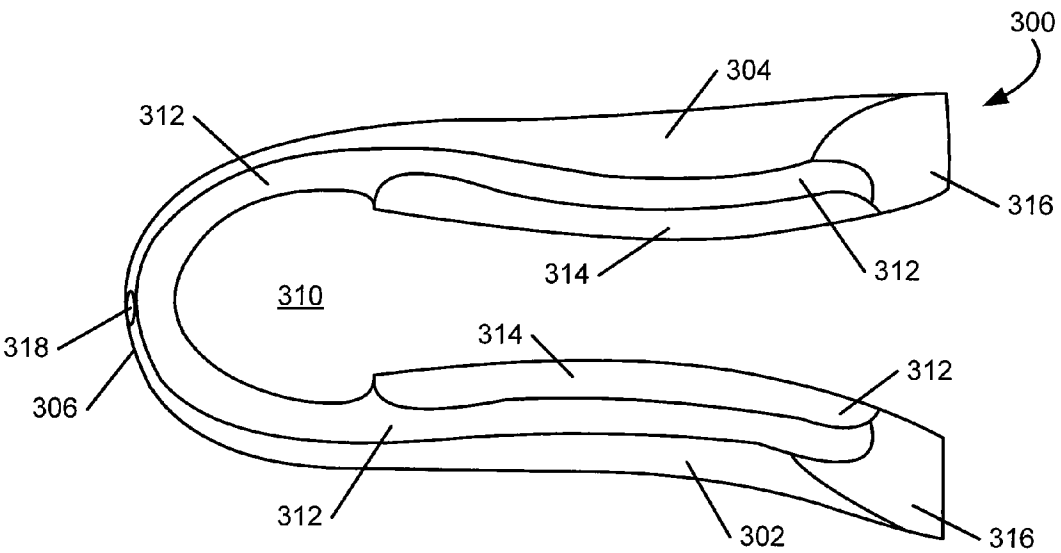

The chassis member 300 of this example sole structure 150 is illustrated in more detail in FIGS. 3A and 3B. As illustrated, this example chassis member 300 includes a first arm 302 that extends along a medial side of the footwear structure 100, a second arm 304 that extends along a lateral side of the footwear structure 100, and a rear heel portion 306 that connects the two arms 302 and 304 (e.g., to form a generally U-shaped chassis structure 300). The chassis member 300 includes an interior surface 308 in which a portion of the bottom exterior surface of the midsole structure 200 is received (e.g., at least the perimeter portions in the heel and arch areas of the midsole structure 200). Notably, as illustrated in FIGS. 1A, 1C, and 3A, the rear heel portion 306 of the chassis member 300 provides an upright surface that extends in an upward direction away from the ground when the sole structure 150 of the footwear structure 100 is placed on the ground.

As noted above, in this example structure 300, the arms 302 and 304 and the rear heel portion 306 of the chassis member 300 are formed in a generally U-shaped structure.

A heel opening 310 is provided through which the interior heel portion 208 of the midsole structure 200 extends or is engaged. The interior heel portion 208 of the midsole structure 200 may extend completely through the heel opening 310, or it may terminate at or substantially flush with the lower surface of the arms 302 and 304 and the rear heel portion 306 of the chassis member 300. The U-shaped chassis member structure 300 of this example further includes a recessed interior perimeter portion 312 for engaging the impact-attenuating member structure 500 and a further recessed interior portion 314 for engaging the upper base support structure 400, as will be described in more detail below. End surfaces 316 of the chassis element 300 engage with the forefoot outsole element 700, as will be described in more detail below. The upper portions of arms 302 and 304 and the rear heel portion 306 are exposed in the final sole structure 150, as shown in FIGS. 1A through 1C.

The chassis member 300 may be made of any desired materials without departing from this invention. In some examples, the chassis member will be made from a relatively stiff and rigid material, such as thermoplastic polyurethane ("TPU") material, a polyether-block co-polyamide polymer material, such as PEBAX® (available from Atofina Corporation of Puteaux, France), a metal or metal alloy material, a glass or fiber reinforced polymer material, etc. If desired, in accordance with at least some examples of this invention, the chassis member 300 may be made from a color that contrasts with other colors of the upper member 102 and/or the sole structure 150, to provide an interesting visual appearance to the sole structure 150. Also, the chassis member 300 may be permanently engaged with the midsole member 200, if desired, or it may simply lie adjacent the midsole member 200 without any permanent engagement. The engagement of members 200 and 300, if desired, may be made in any desired manner without departing from this invention, including, for example, via a friction fit, via cements or adhesives, via mechanical connectors, via retaining elements structures (such as tongue and groove structures), etc. Also, while shown as a one-piece structure 300, the chassis member 300 may be made from multiple pieces without departing from the invention.

The chassis member 300, including the relatively rigid material and its U-shaped structure, provides great stability and support for the article of footwear 100 and the sole structure 150, while not making the sole structure overly heavy, stiff, and non-responsive. For example, the U-shaped structure allows the medial arm 302 and lateral arm 304 to move with respect to one another, to allow for a smooth and comfortable landing (e.g., during a step, from a jump, etc.), while the rigid heel portion 306 provides stable heel support. The U-shaped structure and material choices also can help provide a lightweight structure.

If desired, the rear heel portion 306 of the chassis member 300 may include one or more openings 318 or other structures for engaging a connector element, as will be described in more detail below.

4. Upper Base Support Member

Figure 4A:
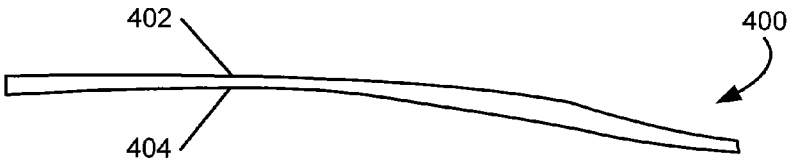
FIGS. 4A and 4B illustrate an example upper base support member that may be included in sole structures and articles of footwear in accordance with this invention.
Figure 4B:
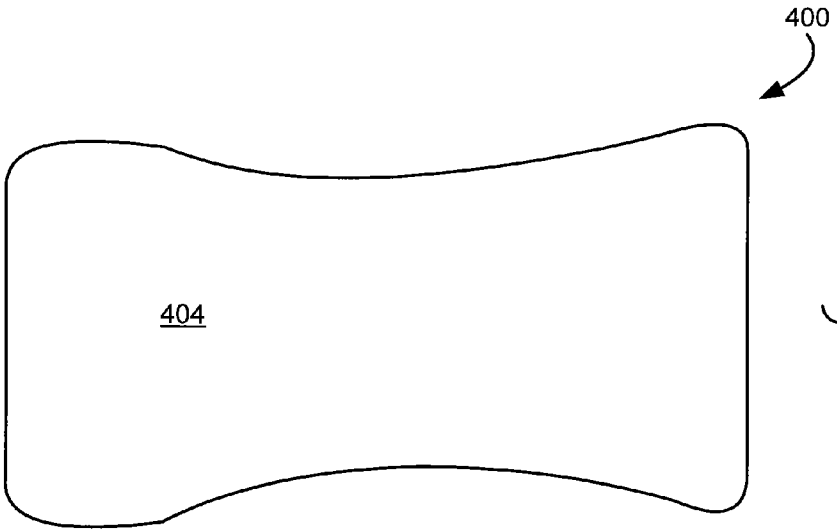

FIGS. 4A and 4B illustrate an example upper base support member 400 that may be included in sole structures 150 in accordance with at least some examples of this invention. This illustrated base support member 400 is essentially an upper plate that fits into the recessed portion 314 provided on the bottom of the chassis member 300. The upper base support member 400 extends from the mid-heel portion of the sole structure 150, along the arch portion 108, toward the forefoot portion 110. The upper surface 402 of the upper base support member 400 engages and supports the arch portion 210 of the bottom surface of the midsole member 200 and may be completely or substantially hidden in this example sole structure 150. The bottom surface 404 of the upper base support member 400 engages the impact-attenuating member 500 (as described in more detail below), and a portion of this surface 404 may remain visible in the final sole structure 150, if desired.

If desired, the upper base support member 400 may simply lie adjacent the chassis member 300 and/or the midsole member 200 without being connected thereto. Alternatively, if desired, the upper base support member 400 may be engaged with the chassis member 300 and/or the midsole member 200. This engagement may be made in any suitable or desired manner, such as via a friction fit, via cements or adhesives, via mechanical connectors, via retaining elements structures (such as tongue and groove structures), etc. Also, the upper base support member 400 may be engaged with the chassis member 300 and the midsole member 200 by the same type of connection system or by different connection systems without departing from this invention (e.g., all connections may be made by adhesives or cements, one connection may be adhesive or cement while the other is via mechanical connectors, etc.). Any type of connection system may be used without departing from this invention, including connection systems that are conventionally known and used in the art.

The upper base support member 400 may be made from any desired materials without departing from this invention, including strong and/or lightweight materials that are conventionally known and used in the footwear art. More specific examples of suitable materials include: metals, such as steel, aluminum (and/or its alloys), titanium (and/or its alloys), magnesium (and/or its alloys), etc.; fiberglass; other fiber reinforced polymeric materials, such as carbon fiber reinforced polymers, basalt fiber reinforced polymeric materials, etc.; polyether-block co-polyamide polymer materials, such as PEBAX® (available from Atofina Corporation of Puteaux, France); other polymeric materials; etc. The support member 400 may be made of any desired thickness without departing from this invention, including conventional thicknesses as are known and used in the art. Also, while shown as a single piece upper base support structure 400 in FIGS. 4A and 4B, if desired, two or more separate support parts may be provided in a single footwear sole structure 150 without departing from this invention. The support member 400 may be made of any desired thickness (including varying thickness over the area of the support member) without departing from this invention, including conventional thicknesses as are known and used in the art (e.g., from 1 mm to 15 mm thick).

5. Impact-Attenuating Member

As noted above, this example sole structure 150 further includes an impact-attenuating member 500. One example member 500 is illustrated in more detail in FIGS. 5A and 5B. As shown, the impact-attenuating member 500 includes an interior surface 502 in which the recessed perimeter portion 312 of the chassis member 300 is received. Additionally, if desired, this interior surface 502 will support all or some portions of the midsole member 200 (e.g., heel portion 208) and/or the upper base support member 400. While the impact-attenuating member 500 may be made from any desired materials without departing from this invention, in at least some example structures according to this invention, the impact-attenuating member 500 may be made from materials like those used in the midsole member 200, such as polyurethane foam, ethylvinylacetate ("EVA") materials (such as phylon), or other foam materials, including midsole or other impact-attenuating materials that are conventionally known and used in the art. If desired, to provide more support and wear resistance, the impact-attenuating member 500 (or at least some portions of it) may be made from somewhat harder or more durable or abrasion resistant materials than the material(s) making up the midsole member 200.

This example impact-attenuating member 500 includes a central heel portion 504 that attenuates a substantial portion of the impact forces resulting from use of the footwear (e.g., such as landing a step or jump). The rear 504*a* of the central heel portion 504 curves or slants upward to maintain contact with the rear heel portion 306 of the chassis member 300 (although it need not extend to the uppermost edge of the rear heel portion 306 of the chassis member 300). The impact-attenuating member structure 500 further includes a medial arm 506 and a lateral arm 508 that are joined at one end by the central heel portion 504 and at the other end by a base member 510. The base member 510 may include an exposed portion 510*a* and an engagement portion 510*b* that is engaged by the outsole element 700 to help hold the impact-attenuating member 500 in the overall sole structure 150, as will be described in more detail below. As shown in FIG. 1B, the exposed portion 510*a* of the impact-attenuating member 500 remains exposed in the overall final sole structure 150 (although this is not a requirement). The central heel portion 504, the medial arm 506, the lateral arm 508, and the base member 510 define an opening 512 through which the bottom surface 404 of the upper base support member 400 is exposed in this example sole structure 150 (although this also is not a requirement).

Figure 5A:
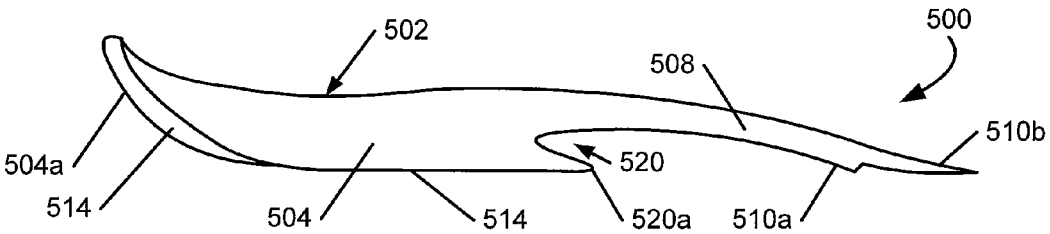
FIGS. 5A and 5B illustrate an example impact-attenuating member that may be included in sole structures and articles of footwear in accordance with this invention.
Figure 5B:
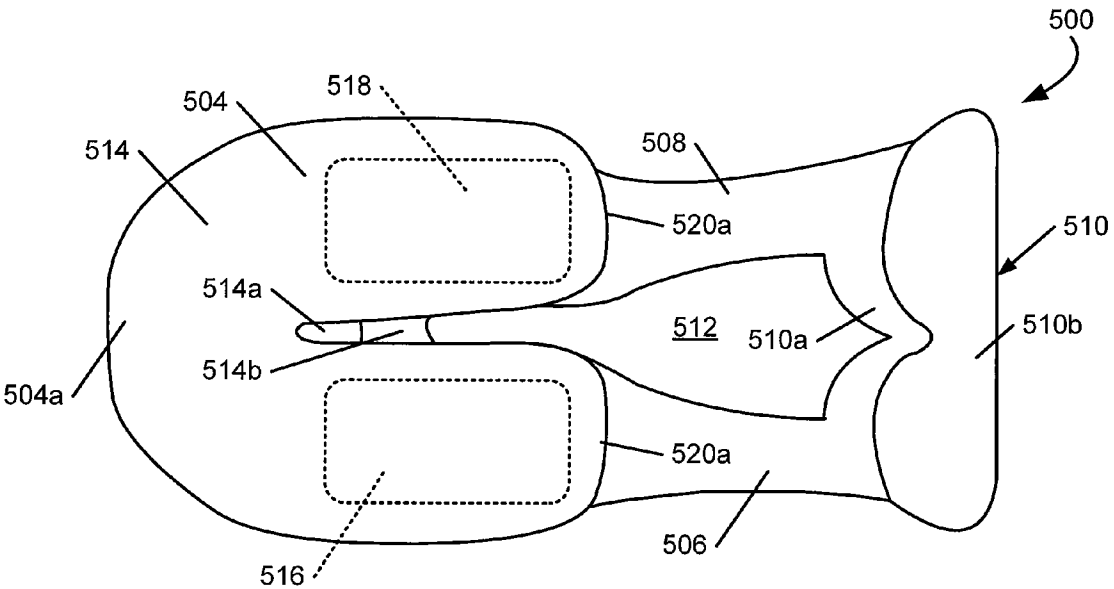

FIG. 5B further illustrates the bottom surface 514 of the impact-attenuating member 500. In this illustrated example structure 500, the bottom surface 514 includes a central groove 514*a* that divides the bottom surface 514 into medial and lateral sides. If desired, at least some portion of this groove 514*a* may include impact-attenuating material bridging across it (shown as bridge member 514*b* in FIG. 5B). Such structures, as will be described below, help reduce weight while also enhancing the stability and comfort properties of the overall sole structure 150 and the article of footwear structure 100.

As shown in FIG. 5B, the central groove 514*a* divides the bottom surface 514 of the impact-attenuating member 500 into two separated areas 516 and 518. As will be described in more detail below, two lower base support members 602 and 604 may be engaged with the impact-attenuating member 500 at these areas 516 and 518. These separated areas 516 and 518 also help enhance the stability and comfort properties of the overall sole structure 150 and the article of footwear structure 100, as described below. Alternatively, if desired, the central groove 514*a* may be eliminated or more grooves may be provided (e.g., thereby dividing the bottom surface 514 into more separated areas). Other bottom surface structures also are possible without departing from this invention.

Like the chassis member 300, the impact-attenuating member 500 may be structured and shaped so as to provide good stability and support for the article of footwear 100 and the sole structure 150, while not making the sole structure 150 overly heavy, stiff, and non-responsive. For example, the two armed structure and opening 512 allow the medial arm 506 and lateral arm 508 to move with respect to one another, to allow better flexibility for a smooth and comfortable landing (e.g., during a step, from a jump, etc.), while the central heel portion 504 provides stable heel support. Moreover, the upper base support member 400 may be located somewhat forward in the heel area so that the heel portion 208 of the midsole member 200 and the rear of the central heel portion 504 of the impact-attenuating member 500 directly contact one another. This arrangement (while optional) provides a soft and comfortable "crash" pad (e.g., when landing a step or jump) while other portions of the sole structure 150 provide stability.

The impact-attenuating member 500 may be engaged with the other elements in the sole structure 150 (such as the upper base support member 400, the chassis member 300, and/or the midsole member 200) in any desired manners without departing from this invention. As some more specific examples, these engagements, if any, may be made via friction fits, via cements or adhesives, via mechanical connectors, via retaining elements structures (such as tongue and groove structures), etc. Also, the impact-attenuating member 500 may be engaged with the upper base support member 400, the chassis member 300, and/or the midsole member 200 by the same type of connection system or by different connection systems without departing from this invention (e.g., all connections may be made by adhesives or cements, one or more connections may be adhesive or cement while one or more other connection are via mechanical connectors, etc.). Any types of connection systems may be used without departing from this invention, including connection systems that are conventionally known and used in the art.

FIG. 5A illustrates another feature of the impact-attenuating member 500 that may be included in at least some example structures 500 in accordance with this invention. As shown, the forward edge of the central heel portion 504 of the impact-attenuating member 500 includes a hollowed out or undercut portion 520 (e.g., having a generally C-shaped profile). As illustrated in FIG. 1A, the lower base support member 600 and the outsole member 800 extend to the end of the lower surface 514 of the impact-attenuating member 500 below the hollowed out or undercut portion 520 (and, optionally, beyond the end of member 500). This hollowed out or undercut portion 520 provides a little more give at the very front of the central heel portion 504 of the impact-attenuating member, to help provide a somewhat softer and more comfortable landing surface. While the undercut portion 520 may extend rearward from the bottom forward edge 520*a* of the impact-attenuating member 500 any desired distance, in accordance with some examples of this invention, the maximum rearward extension in the undercut 520 will range from 1-50 mm, and in some examples from 2-30 mm or even from 3-20 mm.

Finally, while the impact-attenuating member 500 is shown as a single, one-piece construction in FIGS. 5A and 5B, if desired, it may be made from multiple pieces, e.g., separated pieces or pieces that are joined to one another, without departing from this invention. As another example, if desired, the central heel portion 504 may include discrete columnar elements (akin to columnar elements provided in SHOX® type footwear available from NIKE, Inc. of Beaverton, Oreg.), even though the top and/or bottom surfaces of the columnar elements may be joined together by a common base member (e.g., molded as a one piece construction, engaged to a common base member, etc.), if desired. As still another alternative, if desired, the impact-attenuating member 500 may include one or more fluid-filled bladders, as are commonly known and used in the footwear art. Such bladders, when present, may be embedded in a foam material of the impact-attenuating member 500 or at least some portion of the bladder(s) may be exposed in the final sole structure 150. As yet another example, if desired, the entire impact-attenuating member 500 or at least the heel portion 504 may constitute one or more fluid-filled bladders.

6. Lower Base Support Member

Figure 6:
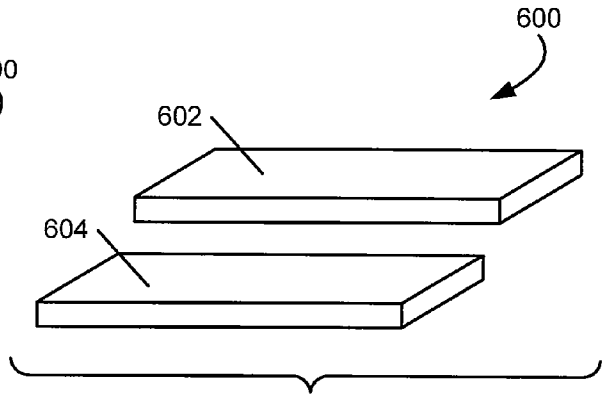
FIG. 6 illustrates example lower base support members that may be included in sole structures and articles of footwear in accordance with this invention.

FIG. 6 illustrates a lower base support member 600 that may be included in sole structures 150 and articles of footwear 100 in accordance with at least some examples of this invention. While the lower base support member 600 in this example structure includes a two piece structure (i.e., medial lower base support member 602 and lateral lower base support member 604), those skilled in the art, given the benefit of this disclosure, will understand that a single lower base support member may be provided (e.g., as a U-shaped plate or other plate), or more than two lower base support members may be provided without departing from this invention.

The lower base support members 602 and 604 may be engaged with the impact-attenuating member 500 (e.g., at areas 516 and 518, respectively) in any desired manner without departing from this invention. For example, the lower base support members 602 and 604 may be engaged with the impact-attenuating member 500 via friction fits, via cements or adhesives, via mechanical connectors, via retaining elements structures (such as tongue and groove structures), etc. When multiple lower base support members are present, they may be engaged with the impact-attenuating member 500 (or other structure in the sole structure 150) in the same or in different manners, without departing from this invention. If desired, areas 516 and 518 may be somewhat recessed into the bottom surface 514 of the impact-attenuating member 500, so that the lower base support members 602 and 604 at least partially extend into this bottom surface 514.

The lower base support member(s) 600 may be made from any desired materials without departing from this invention, including strong and/or lightweight materials that are conventionally known and used in the footwear art. More specific examples of suitable materials include: metals, such as steel, aluminum (and/or its alloys), titanium (and/or its alloys), magnesium (and/or its alloys); fiberglass; other fiber reinforced polymeric materials, such as carbon fiber reinforced polymers, basalt fiber reinforced polymeric materials, etc.; polyether-block co-polyamide polymer materials, such as PEBAX® (available from Atofina Corporation of Puteaux, France); other polymeric materials; etc. Also, when present as multiple pieces, the various pieces of the lower base support member 600 may be the same or different from one another within a single sole structure 150. The support member(s) may be made of any desired thickness (including varying thickness over the area of the support member(s)) without departing from this invention, including conventional thicknesses as are known and used in the art (e.g., from 1 mm to 15 mm thick).

7. Outsole Member

Sole structures 150 in accordance with examples of this invention may include one or more outsole members. Such outsole members may be designed for directly contacting the ground or other contact surface in use, and they may provide traction, wear resistance, etc. As another example, if desired, the outsole elements may provide a base to which other ground contacting elements are mounted, such as cleats, tread members, traction elements, etc. Therefore, an "outsole" member or element need not directly contact the ground in use, but it may simply provide at least a portion of an exterior surface of the final sole structure assembly 150. The outsole member may include any desired number of individual parts or pieces, including conventional parts and pieces as are known and used in the art.

Figure 7A:
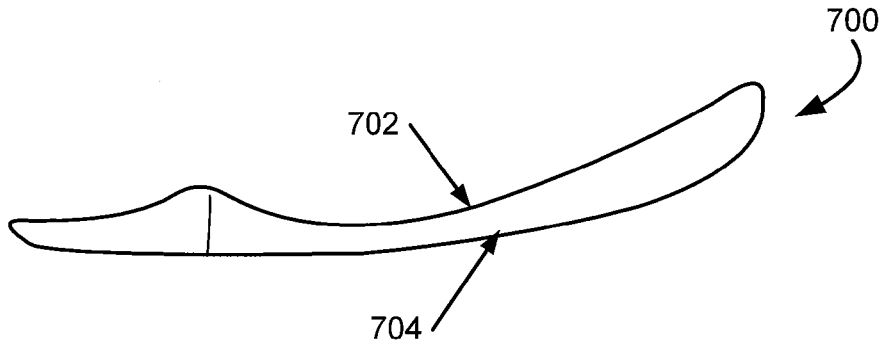
FIGS. 7A and 7B illustrate an example forefoot outsole member that may be included in sole structures and articles of footwear in accordance with this invention.
Figure 7B:
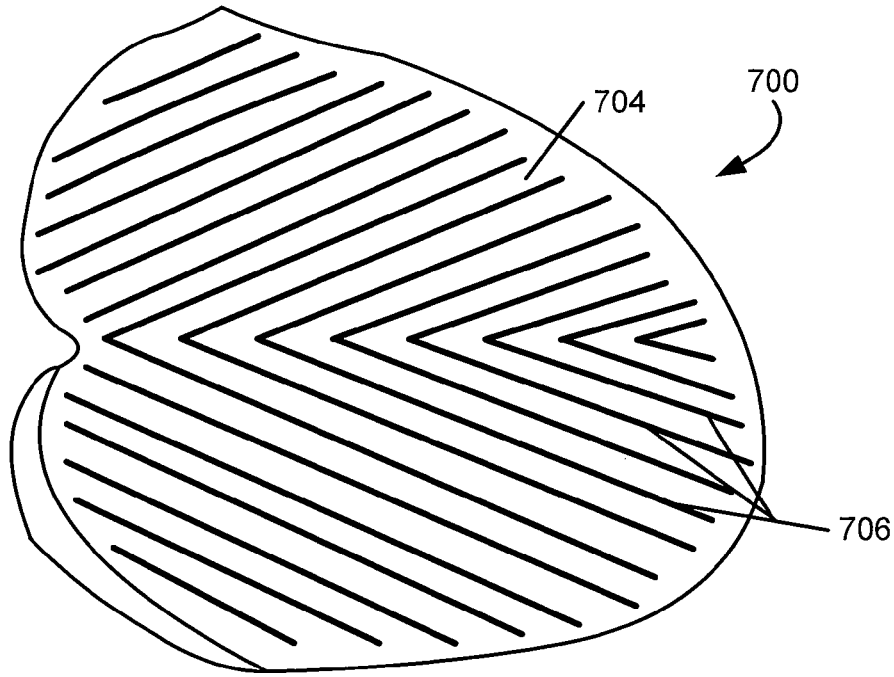

FIGS. 7A and 7B illustrate an example forefoot oriented outsole element 700 that may be used in at least some example structures in accordance with this invention. The interior surface 702 of the outsole element 700 includes a surface for engaging the forefoot portion 212 of midsole member 200, the end surfaces 316 of the chassis member 300, the forward edge of the upper base support member 400, and/or the engagement portion 510*b* of impact-attenuating member 500. The attachment to these other members may be made in any desired manner without departing from this invention, including via friction fits, via cements or adhesives, via mechanical connectors, via retaining elements structures (such as tongue and groove structures), etc. The engagement of the forefoot outsole element 700 with the other members of the sole structure 150 can help hold the sole structure 150 together (at least in the forefoot portion of the shoe 100), and it can help engage the upper member 102 with the sole structure 150 (e.g., either by directly attaching the upper member 102 to the forefoot outsole element 700 or by engaging the upper member 102 with another portion of the sole structure 150 that is in turn engaged (directly or indirectly) with the forefoot outsole element 700).

As shown in FIG. 7B, the bottom surface 704 of the forefoot outsole member 700 may include traction elements 706 that assist in providing traction when contacting a surface in use. Any desired type of traction element(s) may be provided without departing from this invention, including groove structures as shown in FIG. 7B, cleat members (optionally removable cleats), spikes, other tread or traction element designs, etc. The traction elements 706 may be separate parts that are attached to the bottom surface 704 of the outsole member structure 700. Moreover, the bottom surface 704 of the forefoot outsole member 700 may be made of any desired materials without departing from this invention, including conventional materials as are known and used in the art. More specific examples of suitable materials include: rubber (e.g., synthetic rubbers with carbon black or other additives), polyurethanes, thermoplastic polyurethanes, other polymeric materials, etc. If desired, the forefoot oriented outsole member 700 may be made from two or more separate pieces without departing from this invention.

Figure 8A:
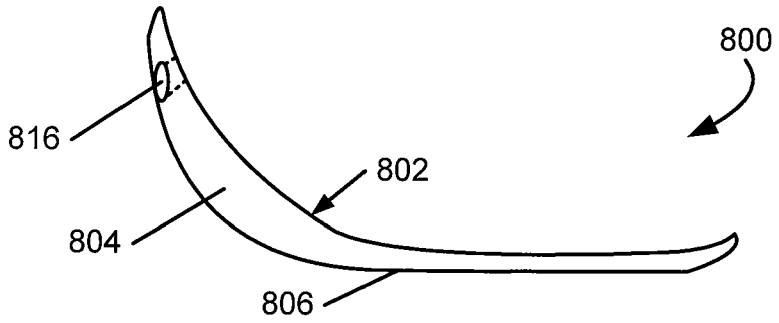
FIGS. 8A and 8B illustrate an example heel outsole member that may be included in sole structures and articles of footwear in accordance with this invention.
Figure 8B:
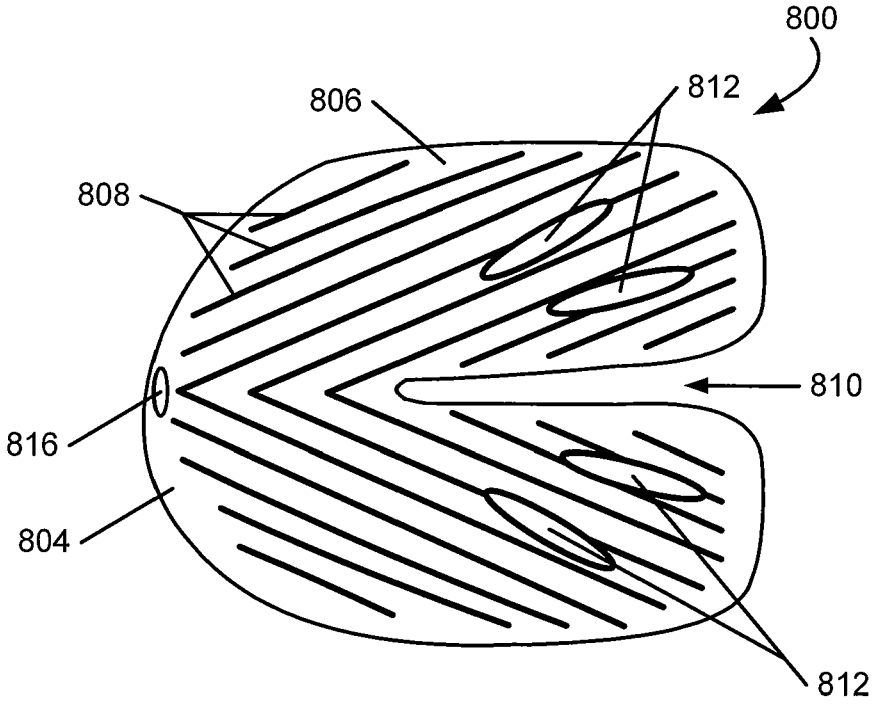

FIGS. 8A and 8B illustrate an example heel oriented outsole element 800 that may be used in at least some example structures in accordance with this invention. The interior surface 802 of this outsole element 800 includes a surface for engaging the bottom surface 514 of the impact-attenuating member 500 and the bottom surfaces of lower base support members 602 and 604. Moreover, the rear heel portion 804 of the heel oriented outsole element 800 may be curved or slanted upward somewhat to further engage the rear heel portion 306 of the chassis member 300 and/or the heel portion 504*a* of impact-attenuating member 500. The attachment to these other members may be made in any desired manner without departing from this invention, including via friction fits, via cements or adhesives, via mechanical connectors, via retaining elements structures (such as tongue and groove structures), etc. The engagement of the heel outsole element 800 with the other members of the sole structure 150 can help hold the sole structure 150 together (at least in the heel portion 106 of the shoe 100), and it can help engage the upper member 102 with the sole structure 150 (e.g., either by directly attaching the upper member 102 to the heel outsole element 800, by engaging the upper member 102 with another portion of the sole structure 150 that is in turn engaged (directly or indirectly) with the heel outsole element 800, and/or via the connector element 814 described in more detail below).

As shown in FIG. 8B, the bottom surface 806 of the heel oriented outsole member 800 may include traction elements 808 that assist in providing traction when contacting a surface in use. Any desired type of traction element(s) may be provided without departing from this invention, including groove structures as shown in FIG. 8B, cleat members (optionally removable cleats), spikes, other tread or traction element designs, etc. The traction elements 808 may be separate parts that are attached to the bottom surface 806 of the outsole member structure 800. Moreover, the bottom surface 806 of the heel outsole member 800 may be made of any desired materials without departing from this invention, including conventional materials as are known and used in the art. More specific examples of suitable materials include: rubber (e.g., synthetic rubbers with carbon black or other additives), polyurethanes, thermoplastic polyurethanes, other polymeric materials, etc. The traction elements 808 and the material of the heel oriented outsole member 800 may be the same as or different from the traction elements 706 and the material of the forefoot oriented outsole member 700 without departing from this invention. If desired, the heel oriented outsole member 800 may be made from two or more separate pieces without departing from this invention.

FIG. 8B illustrates some additional features that may be included in sole structures 150 in accordance with at least some examples of this invention. For example, as shown in FIG. 8B, the heel oriented outsole member 800 includes a central groove 810 extending in the longitudinal direction of the article of footwear 100. While this groove 810 may extend any desired percentage of the overall longitudinal length of the outsole member 800 (e.g., from 1% to 100% of the length), in some examples of structures in accordance with this invention, the groove 810 will extend between 25-75%, or even between 35-65% of the overall longitudinal length. In the illustrated example structure 800, this groove 810 is located so as to be positioned in the final sole structure 150 between the two lower base support structures 602 and 604 described above and overlaying the groove 514*a* of the impact-attenuating member 500. In addition to reducing the weight of the outsole element 800, the groove 810 allows some side-to-side flexibility in the sole structure 150 (along with some of the other features described above) to help provide a stable yet comfortable surface when landing a step or jump.

FIG. 8B further illustrates that the heel oriented outsole member 800 includes one or more windows 812 formed therein. In this illustrated example structure 800, the lower base support members 602 and 604 are visible through these windows 812, as illustrated in FIG. 1B. In addition to reducing the weight of the outsole element 800, the windows 812 can help improve the outsole element's flexibility and provide an interesting aesthetic appearance.

Furthermore, as illustrated in FIGS. 1C and 8A, the rear 804 of the heel oriented outsole member 800 curves or slants upward to maintain contact with the rear 504*a* of the central heel portion 504 of the impact-attenuating member 500 and to meet and contact the rear heel portion 306 of the chassis member 300 (although it need not extend to the uppermost edge of the rear heel portion 306 of the chassis member 300). Engagement between the rear 804 of the outsole member 800 and the rear 504*a* of the central heel portion 504 of the impact-attenuating member 500 and/or the rear heel portion 306 of the chassis member 300 may be accomplished in any desired manner without departing from this invention, including through the use of friction fitting, cements or adhesives, mechanical connectors, retaining elements structures (such as tongue and groove structures), etc. In the example structure illustrated in FIG. 1C, a mechanical connector clip 814 passes through an opening 816 in the rear 804 of the outsole element 800 and through an opening 318 in the rear 306 of chassis member 300 (and optionally through corresponding openings provided in the midsole member 200, the impact-attenuating member 500, and/or the upper member 102) to help hold the outsole element 800 in place with respect to the chassis member 300 and to help hold the overall sole structure 150 and/or footwear structure 100 together. If desired, the opening 816 may include countersinking features so that the head 814*a* of the clip member 814 does not extend outside of the exterior surface of the outsole member 800 adjacent the opening 814. Note also, FIG. 9C, described in more detail below. If desired, this clip member 814 may be removable, e.g., to allow a manufacturer or user (or other party) to exchange and interchange some or all of the parts of the sole structure 150.

8. Construction of the Sole Structure Including the Above Example Structures

Figure 9A:
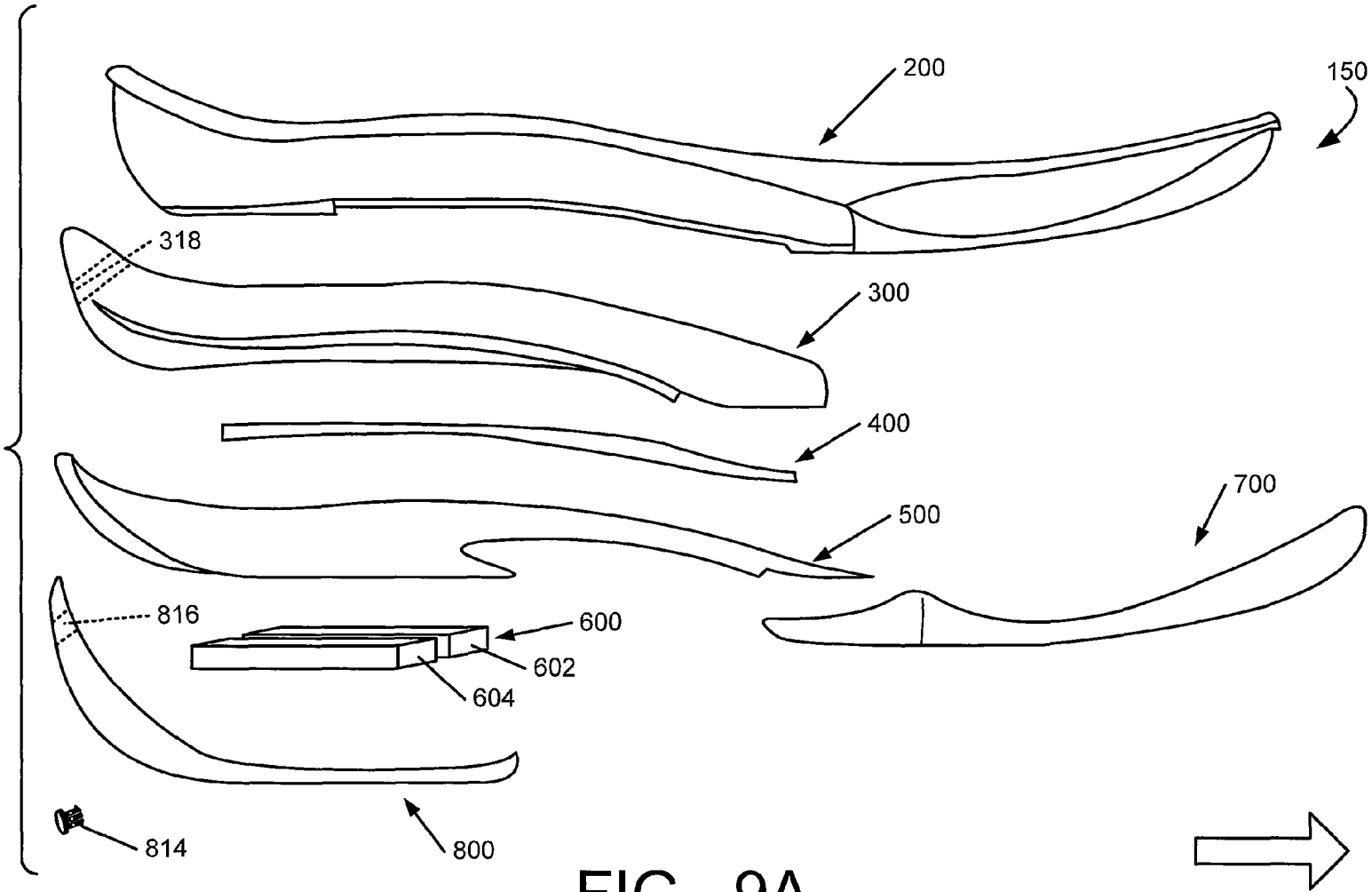
FIGS. 9A through 9C illustrate features of assembling sole structures and articles of footwear in accordance with this invention.
Figure 9B:
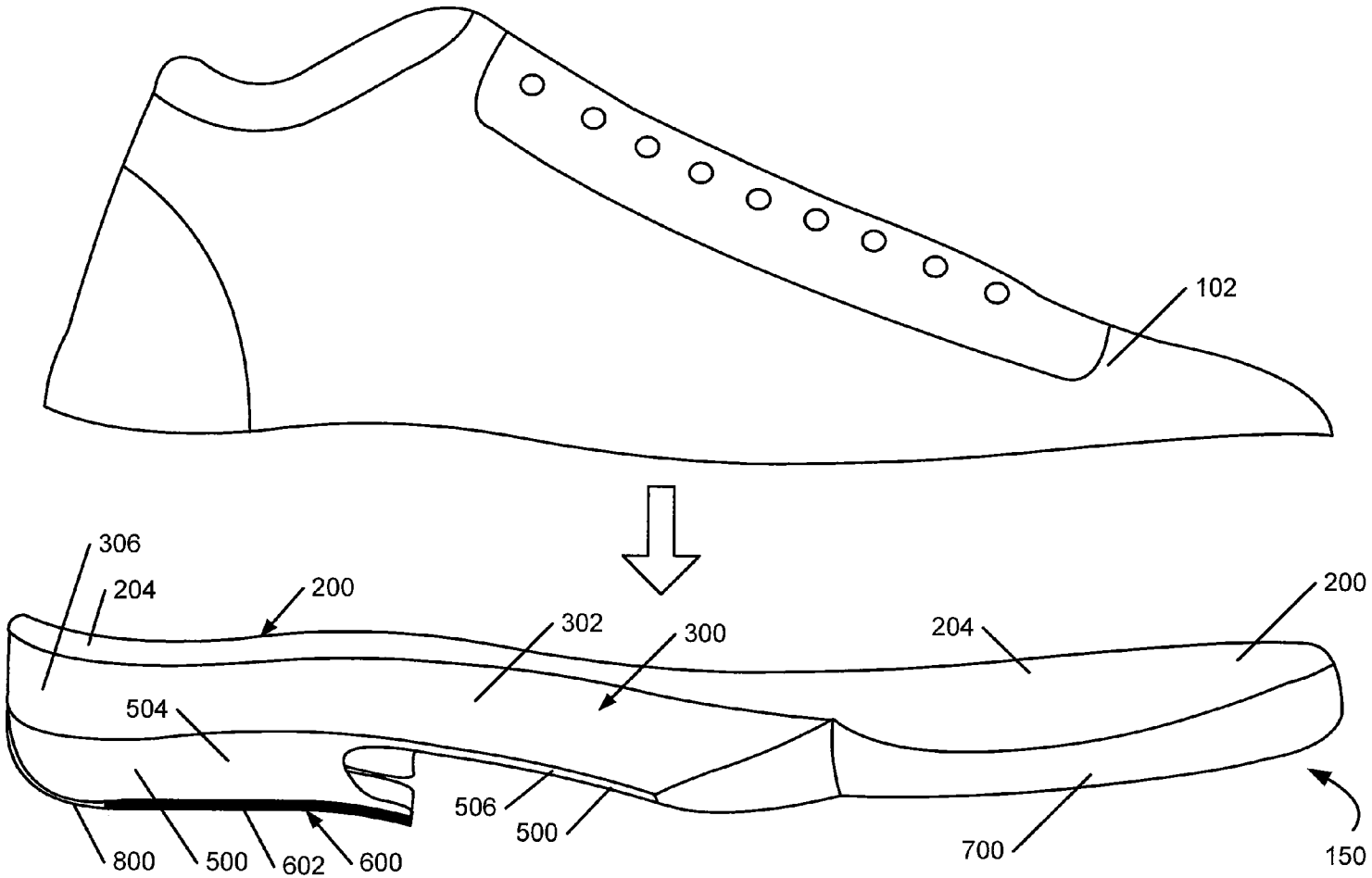
Figure 9C:
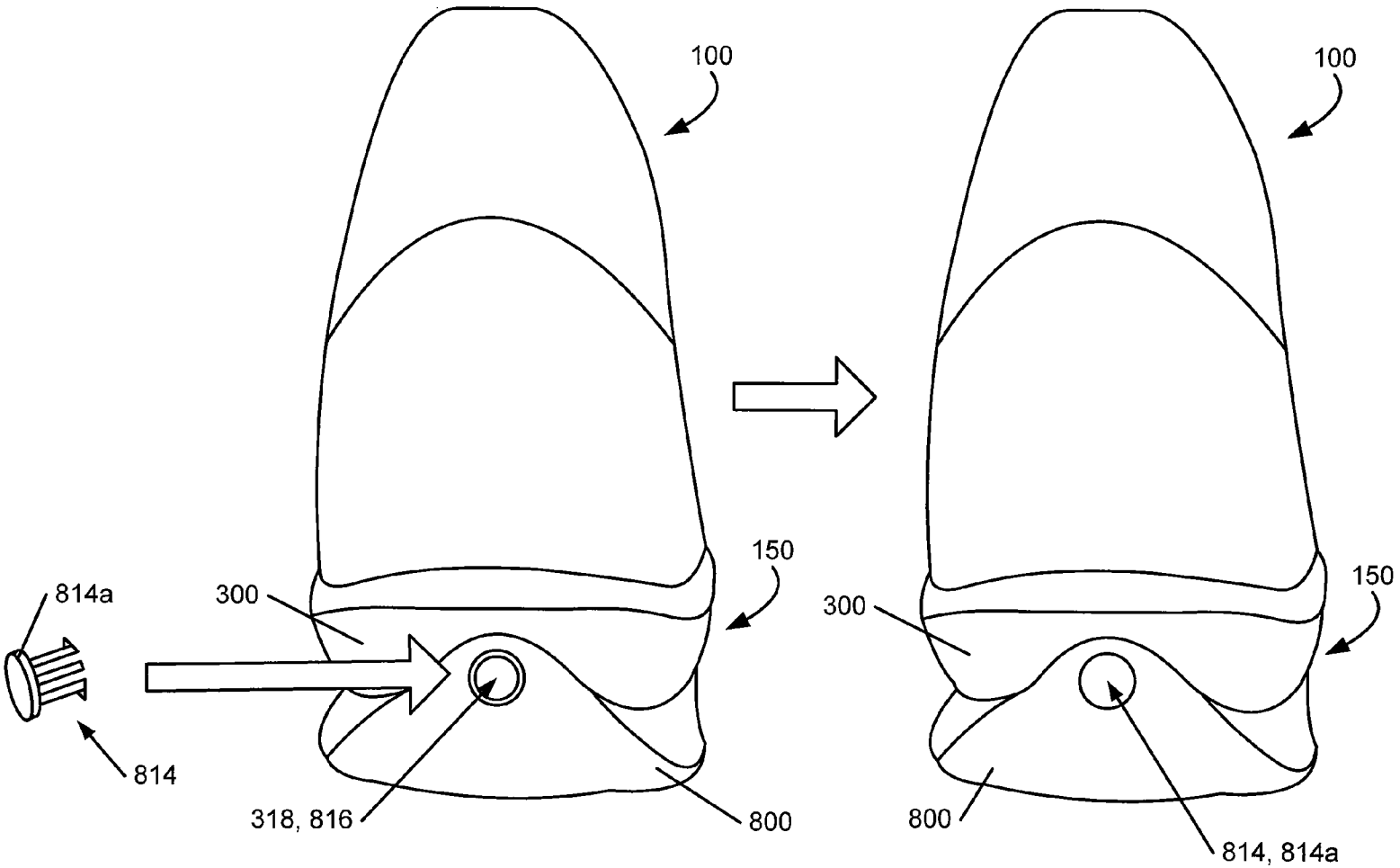

FIGS. 9A through 9C illustrate features of the assembly of the sole structure 150 including the various parts described above. While the general order of elements and assembly arrangements of this example structure 150 are described above, the exploded view of FIG. 9A further helps illustrate how the various parts fit together in the overall sole assembly 150. As noted above, these various parts of the sole structure may be engaged together in any desired manner(s) without departing from this invention, including, for example, via friction fits, via cements or adhesives, via mechanical connectors, via retaining elements structures (such as tongue and groove structures), etc.

Once the sole structure 150 is assembled (or at least some desired portion thereof is assembled), the sole structure 150 (or a portion thereof) may be engaged with an upper member 102, as illustrated in FIG. 9B. This engagement may take place in any desired manner without departing from this invention, including through the use of conventional engagement techniques as are known and used in the art, such as via friction fits, via cements or adhesives, via mechanical connectors, via retaining elements structures (such as tongue and groove structures), etc. Also, as illustrated in FIG. 9C, if desired (in at least some example structures in accordance with this invention), the rear outsole element 800 may be engaged with the chassis member 300 at the rear heel location of the footwear structure 100 via a mechanical connector 814. Any type of connector may be used without departing from this invention. FIG. 9C further illustrates the potential countersink features of the opening 816 in the rear outsole element 800, as mentioned above.

C. CONCLUSION

While the invention has been described with respect to specific examples including presently preferred modes of carrying out the invention, those skilled in the art will appreciate that there are numerous variations and permutations of the above described systems and methods. For example, the various parts described above may take on a variety of shapes and sizes and include additional features or structures without departing from this invention. Additionally, if desired, one or more of the parts may be eliminated from a specific sole structure (e.g., such as one or more of the support members 400, 602, and/or 604) without departing from this invention. As another example, if desired, the structure and/or function of two or more parts may be combined into a single part (e.g., the structure of one or more of the support members 400, 602, and/or 604 may be incorporated into the structure of one of the members engaged with it) without departing from this invention. As still another example, if desired, the article of footwear may include additional elements not specifically illustrated in the drawings or described above, such as heel counter elements, arch support elements, orthotics, other support structures, tongue members, laces, other securing structures, toe caps, etc., including other elements that are known and used in the footwear art. As yet another example, if desired, the outsole element need not extend upward and connect to the chassis member via a connector. Rather, if desired, the outsole member may terminate and the impact-attenuating member may extend in the rear heel area upward, beyond the outsole member, and engage the chassis member (optionally via a connector). Also, the various assembly steps described above may be modified, changed in order, additional steps may be included, and/or steps may be eliminated without departing from this invention.

Additionally, this invention is not limited to athletic footwear, because aspects of this invention may be practiced with other footwear structures, such as dress shoes, sandals, clogs, work boots, and the like. Moreover, aspects of this invention may be practiced in other foot-receiving device products, such as bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

For these reasons, the spirit and scope of the invention should be construed broadly as set forth in the appended claims.

What is claimed is:

1. A sole structure for an article of footwear, comprising:

a midsole member including a heel portion for supporting a wearer's heel and a forefoot portion for supporting a wearer's forefoot;

a first base support member;

a second base support member;

a chassis member located between the midsole member and the first base support member and extending from a lateral side of the midsole member, around the heel portion of the midsole member, and to a medial side of the midsole member, wherein the chassis member includes an opening defined between the medial side and the lateral side, and wherein the heel portion of the midsole member engages the first base support member through the opening in the chassis member;

an impact-attenuating member located between the first base support member and the second base support member, wherein the impact-attenuating member includes a heel portion located between the first and second base support members and an arch portion that extends beyond the second base support member toward a forefoot portion of the sole structure;

a heel outsole element engaged with the second base support member, wherein the heel outsole element extends around a rear heel portion of the impact-attenuating member and engages a rear heel portion of the chassis member; and a forefoot outsole element engaged with at least one of the midsole member, the impact-attenuating member, or the chassis member in the forefoot portion of the sole structure, wherein the arch portion of the impact-attenuating member includes two arms that extend from the heel portion of the impact-attenuating member toward the forefoot outsole element, wherein an opening is defined in the impact-attenuating member between the two arms, and wherein the first base support member is visible through the opening of the impact-attenuating member.

2. A sole structure according to claim 1, further comprising:

a connector for engaging a rear heel portion of the heel outsole element with the rear heel portion of the chassis member.

3. An article of footwear, comprising:

an upper member at least partially defining an interior chamber for receiving a foot; and a sole structure engaged with the upper member, wherein the sole structure includes:

a midsole member including a heel portion for supporting a wearer's heel and a forefoot portion for supporting a wearer's forefoot;

a first base support member;

a second base support member;

a chassis member located between the midsole member and the first base support member and extending from a lateral side of the midsole member, around the heel portion of the midsole member, and to a medial side of the midsole member, wherein the chassis member includes an opening defined between the medial side and the lateral side, and wherein the heel portion of the midsole member engages the first base support member through the opening in the chassis member;

an impact-attenuating member located between the first base support member and the second base support member, wherein the impact-attenuating member includes a heel portion located between the first and second base support members and an arch portion that extends beyond the second base support member toward a forefoot portion of the sole structure;

a heel outsole element engaged with the second base support member, wherein the heel outsole element extends around a rear heel portion of the impact-attenuating member and engages a rear heel portion of the chassis member; and a forefoot outsole element engaged with at least one of the midsole member, the impact-attenuating member, or the chassis member in the forefoot portion of the sole structure, wherein the arch portion of the impact-attenuating member includes two arms that extend from the heel portion of the impact-attenuating member toward the forefoot outsole element, wherein an opening is defined in the impact-attenuating member between the two arms, and wherein the first base support member is visible through the opening of the impact-attenuating member.

4. An article of footwear according to claim 3, wherein the sole structure further includes a connector for engaging a rear heel portion of the heel outsole element with the rear heel portion of the chassis member.

5. A sole structure for an article of footwear, comprising:

a midsole member including a heel portion for supporting a wearer's heel and a forefoot portion for supporting a wearer's forefoot;

a first base support member;

a second base support member;

a chassis member located between the midsole member and the first base support member and extending from a lateral side of the midsole member, around the heel portion of the midsole member, and to a medial side of the midsole member, wherein the chassis member includes an opening defined between the medial side and the lateral side, and wherein the heel portion of the midsole member engages the first base support member through the opening in the chassis member; and an impact-attenuating member located between the first base support member and the second base support member, wherein the impact-attenuating member includes a heel portion located between the first and second base support members and an arch portion that extends beyond the second base support member toward a forefoot portion of the sole structure, wherein the arch portion of the impact-attenuating member includes two arms that extend from the heel portion of the impact-attenuating member toward the forefoot portion of the sole structure, wherein an opening is defined in the impact-attenuating member between the two arms, and wherein the first base support member is visible through the opening of the impact-attenuating member.

6. A sole structure according to claim 5, further comprising:

a heel outsole element engaged with the second base support member.

7. A sole structure according to claim 6, wherein the heel outsole element extends around a rear heel portion of the impact-attenuating member and engages a rear heel portion of the chassis member.

8. A sole structure according to claim 7, further comprising:

a connector for engaging a rear heel portion of the heel outsole element with the rear heel portion of the chassis member.

9. A sole structure according to claim 5, further comprising:

a forefoot outsole element engaged with at least one of the midsole member, the impact-attenuating member, or the chassis member in the forefoot portion of the sole structure.

10. An article of footwear, comprising:

an upper member at least partially defining an interior chamber for receiving a foot; and a sole structure engaged with the upper member, wherein the sole structure includes:

a midsole member including a heel portion for supporting a wearer's heel and a forefoot portion for supporting a wearer's forefoot, a first base support member, a second base support member, a chassis member located between the midsole member and the first base support member and extending from a lateral side of the midsole member, around the heel portion of the midsole member, and to a medial side of the midsole member, wherein the chassis member includes an opening defined between the medial side and the lateral side, and wherein the heel portion of the midsole member engages the first base support member through the opening in the chassis member, and an impact-attenuating member located between the first base support member and the second base support member, wherein the impact-attenuating member includes a heel portion located between the first and second base support members and an arch portion that extends beyond the second base support member toward a forefoot portion of the sole structure, wherein the arch portion of the impact-attenuating member includes two arms that extend from the heel portion of the impact-attenuating member toward the forefoot portion of the sole structure, wherein an opening is defined in the impact-attenuating member between the two arms, and wherein the first base support member is visible through the opening of the impact-attenuating member.

11. An article of footwear according to claim 10, wherein the sole structure further includes a heel outsole element engaged with the second base support member.

12. An article of footwear according to claim 11, wherein the heel outsole element extends around a rear heel portion of the impact-attenuating member and engages a rear heel portion of the chassis member.

13. An article of footwear according to claim 12, further comprising:

a connector for engaging a rear heel portion of the heel outsole element with the rear heel portion of the chassis member.

14. An article of footwear according to claim 10, further comprising:

a forefoot outsole element engaged with at least one of the midsole member, the impact-attenuating member, or the chassis member in the forefoot portion of the sole structure.

* * * * *